United States Patent [19]

Cardamone

[11] Patent Number: 5,048,738

[45] Date of Patent: Sep. 17, 1991

[54] INTERCHANGEABLE TAPE CUTTER

[76] Inventor: Tom Cardamone, Grand Central Post Office, Lex. Ave. & 45th St., New York, N.Y. 10017-9998

[21] Appl. No.: 936,383

[22] Filed: Nov. 21, 1986

[51] Int. Cl.[5] ..... B26F 3/02

[52] U.S. Cl. ..... 225/56; 225/91

[58] Field of Search ..... 225/25, 26, 56, 61, 225/66, 90, 91

[56] References Cited

U.S. PATENT DOCUMENTS

| | | | |
|---|---|---|---|
| 2,203,073 | 6/1940 | Anderson | 225/26 |
| 2,272,628 | 2/1942 | Anderson | 225/26 |
| 2,300,655 | 11/1942 | Davenport | 225/90 |
| 2,560,394 | 7/1951 | Slezak | 225/90 |
| 2,578,519 | 12/1951 | Double | 225/25 |
| 2,592,865 | 4/1952 | Corey | 225/91 |
| 2,611,432 | 9/1952 | Tallman | 225/25 |
| 2,626,666 | 1/1953 | Coldiron | 225/90 |
| 2,717,641 | 9/1955 | Wiederspan | 225/90 |
| 2,727,572 | 12/1955 | Di Carlo | 225/90 |
| 2,734,576 | 2/1956 | Slezak | 225/65 |
| 2,815,125 | 12/1957 | Thompson | 225/90 |
| 3,450,318 | 6/1969 | Turner | 225/90 |

FOREIGN PATENT DOCUMENTS

| | | | |
|---|---|---|---|
| 736499 | 9/1955 | United Kingdom | 225/26 |

*Primary Examiner*—Hien H. Phan

*Attorney, Agent, or Firm*—Mark P. Stone

[57] ABSTRACT

The present invention provides a tape cutting tool having a body portion and one forward cutting edge. In one embodiment, resilient lateral sides of the body portion engage the outer sidewalls of a spool-less roll of tape; in a second embodiment the resilient lateral sides engage the inner sidewalls of a spool holding the tape; and in a third embodiment the lateral sides engage the outer sidewalls of a spool holding the tape. The tool is slideable along the periphery of the roll of tape or the spool holding the tape, and the forward cutting edge is employed to sever predetermined lengths of tape from the roll. In all embodiments, the tool is designed so that the leading edge of tape remaining on the tape roll, after a length of tape has been severed, is maintained apart from the tape roll to provide easy access to the leading edge when the next piece of tape is to be cut from the roll, and the tape is severed at an optimum angle relative to the cutting edge.

4 Claims, 4 Drawing Sheets

INTERCHANGEABLE TAPE CUTTER

BACKGROUND OF THE INVENTION

The present invention relates to a tape cutting tool specifically for pressure-sensitive medical adhesive tape or the like which is supplied on the core of a rimmed spool as well as a cutting tool for tape rolled on a core without side rims such as drafting tape, electrical tape, plastic tape, fiber tape, strapping tape, masking tape and the like. The cutting tool can be constructed in various sizes to accommodate different spools or tape widths, and additionally can be used on rolls of any core diameter without adjustment of the cutter.

It is an object of the invention to provide an inexpensive cutter for spooled medical adhesive tape, which is simple in design and application, made of durable, inexpensive yet substantially hard plastic or any such material allowing ease of cutting and continued use of the cutter with the added advantage of being able to be easily removed from one spool tape roll and applied to another.

It is a further object of the invention to provide a cutting tool which is particularly adapted for use in connection with tape rolled on a core not having side rims.

It is still a further object of the invention to provide a cutting tool which may be used in connection with tape rolls having side rims.

It is yet another object of the invention to provide a tape cutting tool designed to prevent the leading edge of a tape roll from adhering to the roll after a piece of tape has been severed from the roll, and which is designed to assure that tape is cut from the roll at an optimum angle.

Additional objectives of the invention will become apparent through the following description and claims and attached drawings.

SUMMARY OF THE INVENTION

The present invention provides a tape cutting tool having a resilient main body portion and a forward cutting edge for severing selected lengths of tape from a tape roll. In one embodiment of the invention, the body portion of the tape cutter includes resilient side grippers which engage the outer sidewalls of a tape roll wound on a core but not having side rims. The cutter body is slideable along the periphery of the tape roll, and the forward cutting edge is employed to sever selected lengths of tape from the roll. The tool includes a forward roll rim defined beneath and behind the forward cutting edge. The roll rim cooperates with the cutting edge to prevent the leading edge of the tape on the roll from adhering back to the roll after a piece of tape has been severed from the roll, and to assure that pieces of tape are severed from the roll at an optimum angle. The body of the cutter may be designed to define a hollow cavity on its underside, and this cavity may be employed to protect the raised leading edge of tape.

In a second embodiment of the invention similar to the first, the cutting tool is mounted to and slideable along the periphery of the sidewalls of rims of a spool holding the tape. The forward roll rim and cutting edge of the cutter cooperate in the same manner described above.

In a further embodiment of the invention, the cutting tool is adapted to be received within the sidewalls of a rimmed spool around which the tape is rolled. The body of the tool exerts a resilient force outwardly on the inner sidewalls of the spool to retain the tool within the rimmed spool. In this embodiment of the invention, the underside of the tool is curved in a direction toward an upper leading cutting edge for preventing the end of the tape on the roll from adhering to the roll after a piece of tape has been cut and for assuring that the tape is cut at an optimum angle. Additionally, this second embodiment of the invention may be stored within the sidewalls of the rim of the tape spool on the periphery of the tape roll when the cutter is not in use.

In all embodiments of the invention, the cutting tool is slideable along the periphery of the tape roll or the rim of the spool holding the tape roll. The cutting tool may readily be removed from one tape roll and applied to another. The cutting tool provides a simple, yet effective tool for quickly and easily removing short or long lengths of adhesive tape from a rimmed spool or from the core of a rim-less spool. The tool may be manufactured in a number of different sizes to accommodate different widths of spools or tape rolls, and may be manufactured from a durable yet inexpensive material such as substantially hard plastic.

DISCUSSION OF THE BEST MODES FOR CARRYING OUT THE INVENTION

Figure 1:
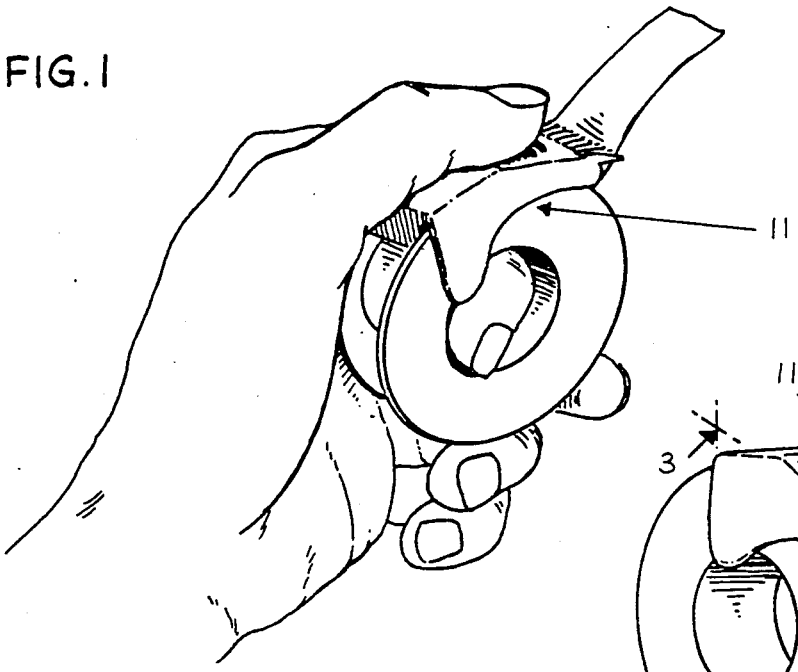
FIG. 1 is a rear perspective view of the cutter held on the periphery of a rimmed spool containing a roll of medical adhesive tape in readiness for use.
Figure 2:
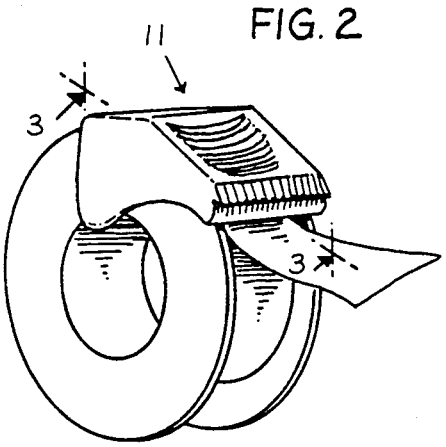
FIG. 2 is a view of the cutter shown in FIG. 1 from a front perspective.
Figure 3:
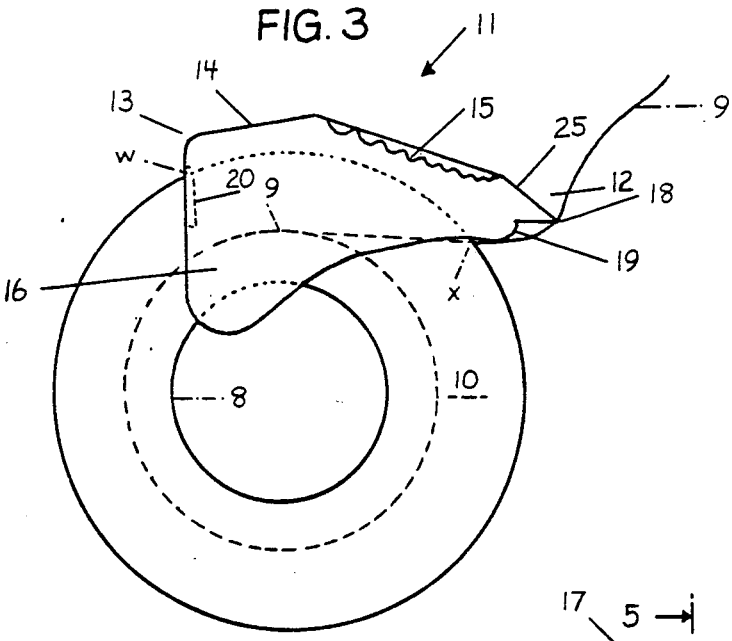
FIG. 3 is a slide elevation view of the cutter mounted on a spool along line 3—3 of FIG. 2.
Figure 4:
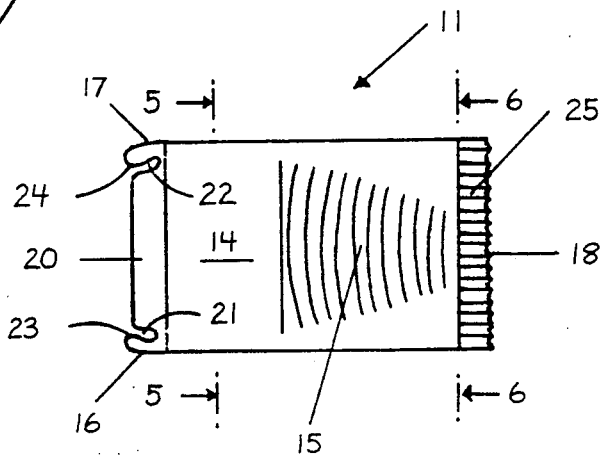
FIG. 4 is a top plan view of said cutter.
Figure 5:
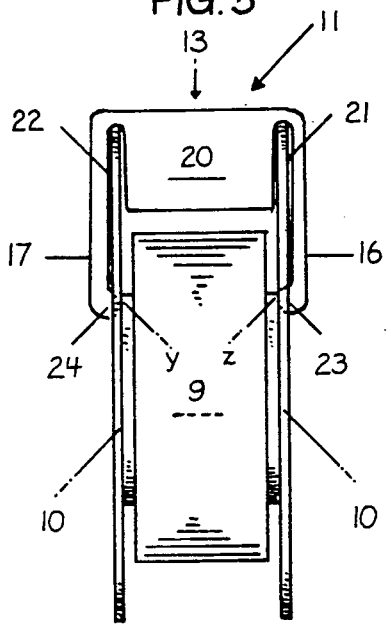
FIG. 5 is a rear elevation view of the cutter mounted on a spool along line 5—5 of FIG. 4.
Figure 6:
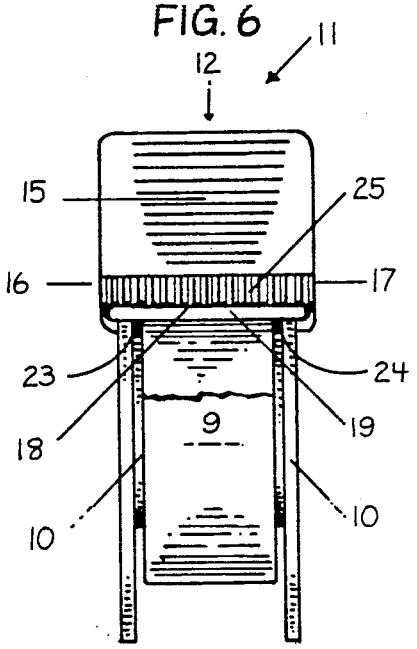
FIG. 6 is a front elevation view of the cutter mounted on a spool along line 6—6 of FIG. 4.
Figure 7:
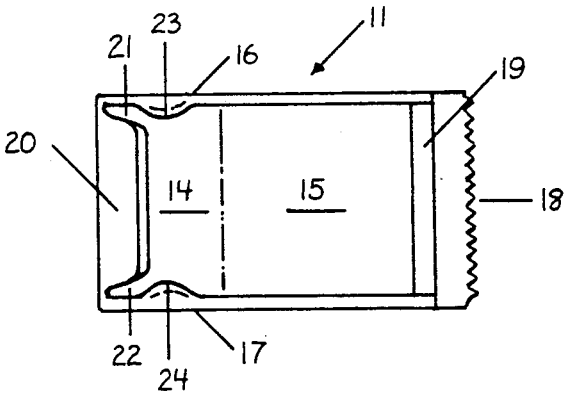
FIG. 7 is a bottom plan view of the cutter.
Figure 8:
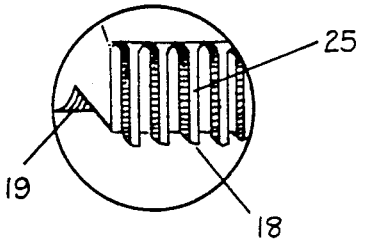
FIG. 8 is an enlarged detail of a section of the front cutting edge of the cutter.
Figure 9:
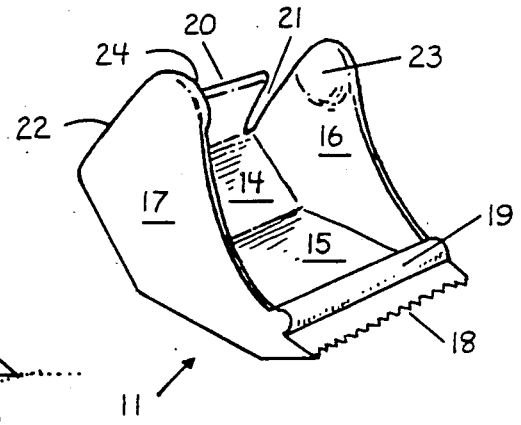
FIG. 9 is a bottom perspective view of the underside of the cutter.
Figure 10:
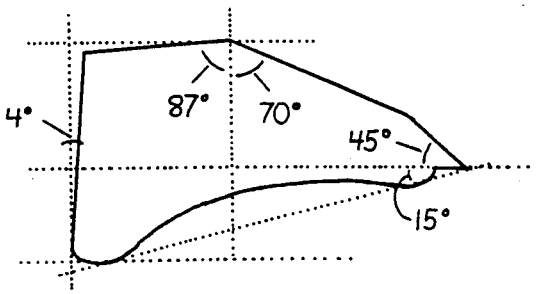
FIG. 10 is a side elevation schematic view of the specific functional design configuration of the cutter.

Referring first to FIGS. 1-10 of the drawings, the body 11 of the tape cutter of the invention is composed of a front transverse portion 12 and a rear transverse portion 13 which are designed so that the uppermost portion of the rim slots 21 and 22 which are created by the support slot tab 20 of the rear portion 13 and the forward roll rim 19 of the forward portion 12 are positioned in contact with w and x of the periphery of a rimmed spool; the resilient side grippers 16 and 17 at opposite ends of the rear portion 13 which press the gripper lock pads 23 and 24 firmly against the sides of the rim y and z of the inner core of the spool.

These portions include a rear support platform 14 shown as part of the rear portion 13. A transverse cutting edge 18 is located at the extremity of the forward portion 12 from which a narrow transverse row of cutting extension ribs 25 extent backward to the forward thumb grooved depression 15. When positioned on the periphery of a spool rim, supported by the rear portion assembly 20, 21 and 22 and the forward roll rim 19 the resilient side grippers 16 and 17 extend downwardly over the sides of the rim 10 to a point just below and into the inner opening of the spool. In this position the gripper lock pads 23 and 24 engage in the inner core rim 8 of the spool. The resilient side grippers 16 and 17 originate at the forward rim roll 19 and extend backward in a sweeping curve downwardly to its lower, rear extremity, resulting in a design configuration which sufficiently assists the resiliency of the said grippers 16 and 17; the said grippers 16 and 17 are tapered inwardly to a calculated point to create sufficient holding capabilities for the gripper lock pads 23 and 24. The gripper lock pads 23 and 24, being smooth and slightly rounded in shape and the only point of contact with the spool, permit slideability against the edges of the inner core rim periphery 8 of the spool while sufficiently locking the cutter in position to prevent it from falling off but not so tightly as to inhibit its slideability or removal by the user. The resilient side grippers 16 and 17 which contain the gripper lock pads 23 and 24 will return to their normal, tapered position once removed from the spool. The inward taper and outward flexibility of the side grippers 16 and 17 have been designed to accommodate variations in tape manufacturing width + or − one sixteenth of an inch.

To use the cutter it is positioned onto the spool allowing the two side grippers 16 and 17 and the gripper lock pads 23 and 24 to slide over the outer sides of the rim of the spool 10 with a downward pressing motion thus engaging the edges of the spool rim 10 into the rim slots 21 and 22 at the rear transverse portion 13 of the cutter. In this position the cutting edge 18 of the tool is facing the same direction as the leading edge of the adhesive tape 9. In this position the forward roll rim 19 of the cutter rests on the peripheral edges of the spool rim 10 thus positioning the cutting edge 18 at such an angle as to enhance leverage for easy cutting of the tape. The combined rim slots 21 and 22, side grippers 16 and 17 and the gripper lock pads 23 and 24 offer sufficient pressure to hold the tool in proper position for maximum cutting efficiency. Thus positioned on the rim of the spool the user places his (her) thumb on the forward upper grooved depression 15 of the cutter; in this position the joint of the thumb is automatically positioned correctly on the rear support platform 14; the index finger is placed through the open core 8 of the spool; in this position the index finger engages the bottom edtes of the side grippers 16 and 17 as well as the inner edges of the core 8, thus contributing to the support and leverage of the cutter; the remaining fingers are positioned against the lower outside rim of the spool. With the other hand the user lifts the tape end from the roll and pulls the tape allowing the spool to spin around the index finger and through the rim slots 21 and 22 of the cutter. With a relaxed hand grip the user's thumb simultaneously holds the cutter down, preventing it from popping off the roll while the index finger supports the rolling action of the spool. When a desired length of tape is pulled from the roll the user presses the cutter firmly with his (her) thumb, lifts the tape back against the cutting edge 18 of the cutter and pulls to the left or right to tear the rape from the roll. The cutting action and capability of the cutting edge 18 is supported by the row of transverse extension ribs 25; each cutting point of the cutting edge 18 extends upward and back to form a row of elongated grooved cutting ribs 25 which engage and guide the fibrous tape material after the initial puncturing by the sharply pointed cutting edge 18 thus assisting the ease of cutting. The rear portion 13 of the uppermost support platform drops sharply to form the support table 20 providing a raised surface to be used to push against for a forward manipulation of the cutter; said support tab 20 and forward thumb grooved depression 15 facilitate a forward and backward manipulation of the cutter. Because the transverse cutting edge 18 is positioned above and slightly forward of the forward rim roll 19 and the angle and distance of said cutting edge 18 is such that a sufficient lead length of tape will remain attached to the cutting edge 18 and raised from the roll for easy grasping and pulling by the user. This is accomplished by the transverse extension ribs which comb through and engage the fine gummy fiber threads that remain after the adhesive tape is cut thus holding the tape end between the cutting points of the cutting edge 18. The forward rim roll 19 and the cutting edge 18 are designed to project from peripheral edge of the spool rim at an angle to enhance cutting capability. The lower and underneath portion of the body 11 is hollow, flanked on four sides by the forward roll rim 19, the rear support tab 20 and the left and right side grippers 16 and 17. The only portions of the lower underside section of the body 11 that come in contact with the spool are the uppermost end of the two slot tabs 21 and 22, the two gripper lock pads 23 and 24 and the forward rim roll 19.

When the body 11 is placed in position on the rim of the spool the forward rim roll 19 comes in contact with the spool rim periphery x, the uppermost part of the rim slots 21 and 22 rest against the peripheral rim of spool w and the two gripper lock pads 23 and 24 against the edge of the inner core rim y and z all of which are rounded to afford minimum friction yet allow maximum support and slideability of the cutter.

Figure 11:
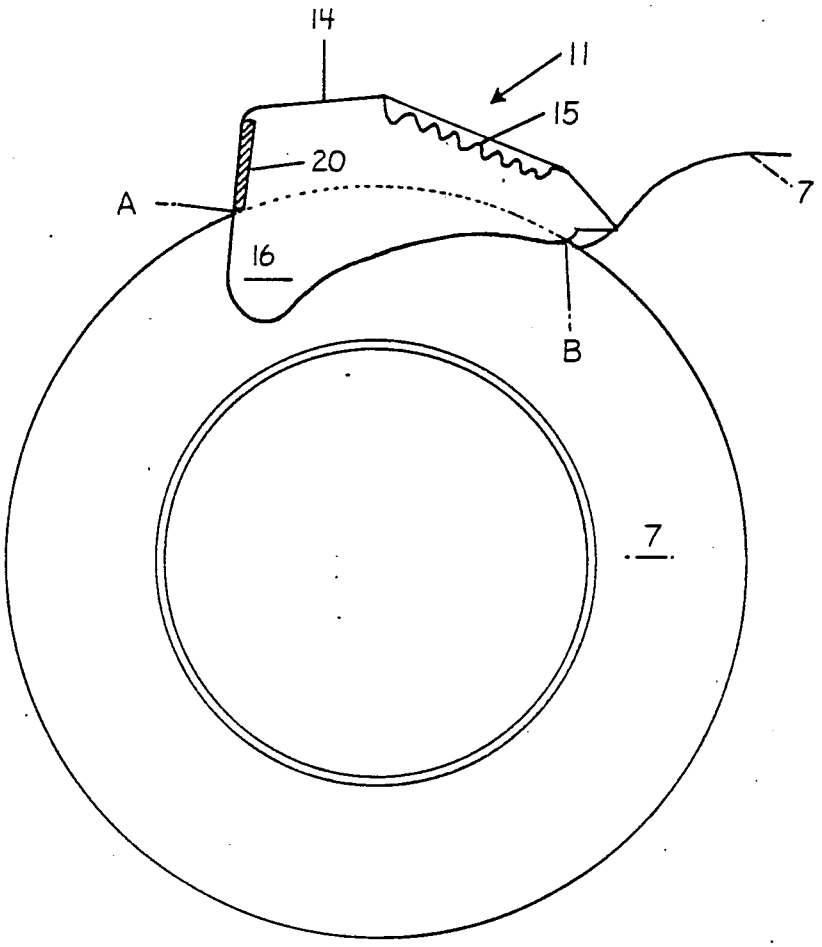
FIG. 11 is a slide elevation of the cutter mounted directly on a roll of tape.
Figure 12:
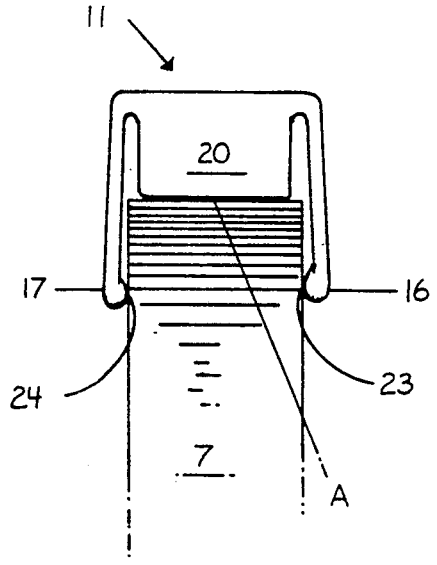
FIG. 12 is a rear elevation view of the cutter shown in FIG. 11.
Figure 13:
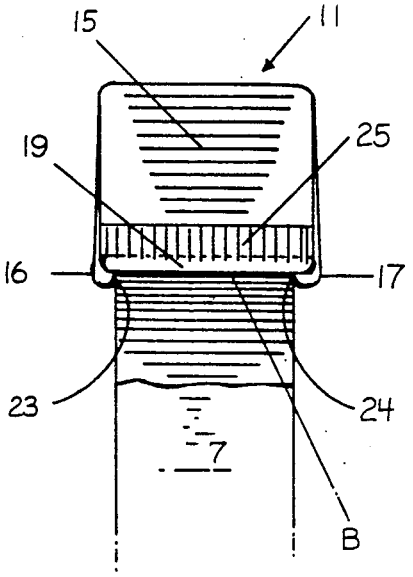
FIG. 13 is a front elevation view of the cutter shown in FIG. 11.
Figure 14:
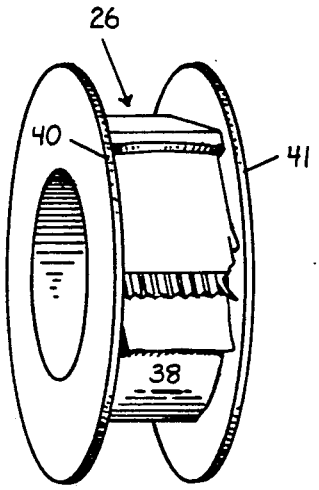
FIG. 14 is a front perspective view of an embodiment of the invention in which the cutter is held in position on the surface of a roll of medical tape between the rims of a spool.
Figure 15:
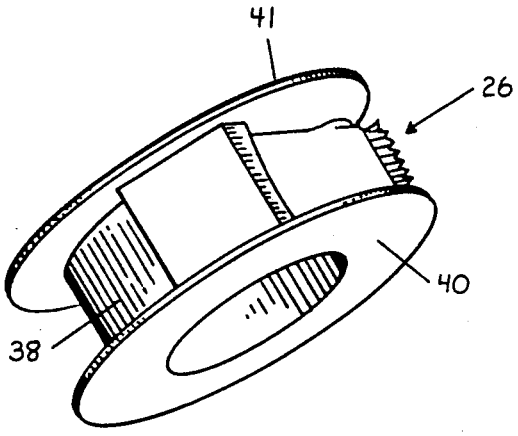
FIG. 15 is a view of the cutter shown in FIG. 14 from a top perspective.
Figure 16:
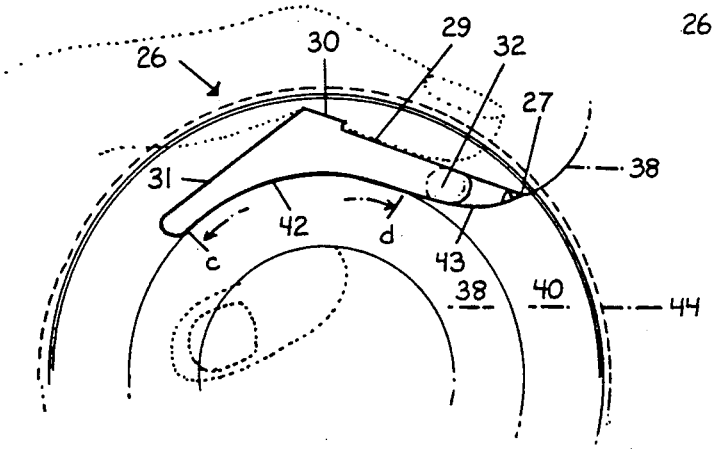
FIG. 16 is a side elevation view of the cutter shown in FIG. 14 mounted on a roll of tape held between the rims of a spool.
Figure 17:
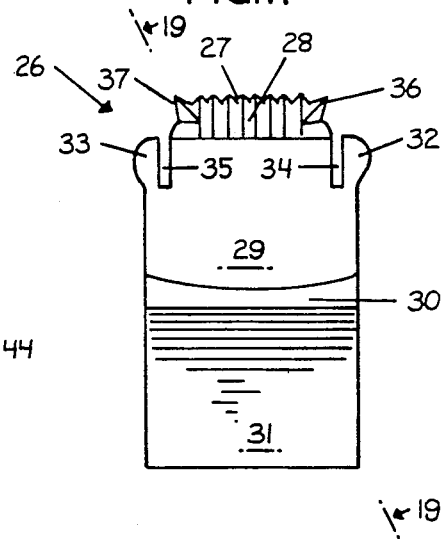
FIG. 17 is a top plan view of the cutter shown in FIG. 14.
Figure 18:
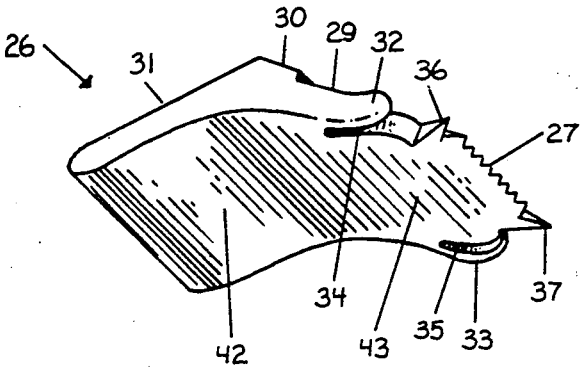
FIG. 18 is a bottom perspective view of the underside of the cutter shown in FIG. 14.
Figure 19:
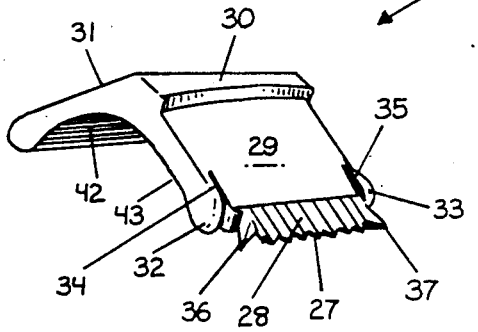
FIG. 19 is a perspective view of the cutter as seen along line 19—19 of FIG. 17.

Referring now to FIGS. 11-13 of the drawing, the same cutting device described with regard to FIGS. 1-10 is now shown directly mounted to a roll of tape not wound on a rimmed spool. These drawing figures illustrate that the body of the cutter is held in place on a roll of any of a variety of pressure sensitive tapes such as masking tape having no spool side rims. This is done by snapping the main body 11 onto the roll 7 by allowing the resilient side grippers 16 and 17 to stretch out and over the sides of the roll 7 thus hugging the sides of the said roll. In this position the body 11 and resilient side grippers 16 and 17 are slideable around the circumfrence of the roll; the gripper lock pads 23 and 24 are pressed sufficiently against the sides of the roll to prevent it from falling off as well as guide the cutter around the roll when in use. The forward roll rim 19 rests on the circumferential surface of the roll which positions the transverse cutting edge 18 at such an angle and relative position as to enhance leverage for easy cutting of the tape. When positioned as just described the rear support tab 20 is also in contact with the surface of the tape. Thus positioned on the circumferential surface of the tape the user places his (her) thumb on the forward upper grooved surface 15 of the tool, the joint of the thumb automatically falls in proper position on the rear support platform 14; the remaining fingers are placed through the open core of the tape roll. With the other hand the user lifts the tape end from the roll and pulls the tape allowing the roll to spin around the fingers and between the side gripper lock tabs 23 and 24. With a relaxed but controlled hand grip the user's thumb simultaneously holds the cutter down, preventing it from popping off the roll. When a desired length of tape is pulled from the roll the user presses the cutter firmly with his (her) thumb, lifts the tape back against the cutting edge 18 and pulls to the left or right to tear the tape from the roll. The cutting capability of the cutting edge 18 is further supported by the row of transverse extension ribs 25 which comb through the tape as it is punctured and firmly guide the tape along the cutting edge 18 to prevent the tape from binding. The rear portion 13 is raised to form the support tab 20 which is also used as a surface to push against for a forward manipulation of the cutter; the combined support tab 20 and the forward thumb grooved depression 15 facilitate a forward and backward manipulation of the cutter. Because the transverse cutting edge assembly 18 and 25 is positioned above and slightly forward of the forward rim roll 19 the angle and distance of said cutting edge 18 is such that a short lead length of tape will remain curled and raised from the surface of the roll for easy grasping and pulling by the user. The lower and underneath portion of the body 11 is hollow, flanked on four sides by the forward roll rim 19, the rear support tab 20, and the left and right side grippers 16 and 17. The only portions of the cutter that come in contact with the tape are the underside of the forward roll rim 19 and the rear support tab 20 which rest on the circumferential surface at points A and B of the tape and the gripper lock pads 23 and 24 which engage the sides of the roll all of which are rounded to afford minimum friction yet allow maximum support and slideability of the cutter.

The hollow underside portion of the body may be used to protect the raised end of tape when the cutter is not in use by merely placing the hollow portion of the main body over the raised lead edge of tape. The cavity defined by the hollow portion is sufficiently large and deep to house the raised end of the tape. In this position, the cutter may be moved slightly backwards along the tape roll until the forward roll rim of the cutter engages the gummed underside of the raised edge of tape to secure the end in a raised position in readiness for the next application.

In this embodiment of the invention, the cutter is mounted directly on the periphery of the tape roll and the resilient lateral side arms of the cutter hug the tape roll to automatically adjust the cutter to the depth of the tape roll until the last piece of tape is severed from the roll. The depth and downward sweep of the rear portion of the side gripper is calculated to permit the lock pads to lock into the core of the tape roll when the tape has been dispensed below a predetermined level. The side grippers are also designed to be of a depth such that the gripping engagement with the sidewalls of the tape roll is sufficiently below the periphery of the tape roll to prevent a binding action between the side grippers and the layers of tape on the roll. In this regard, the only portion of the side grippers that directly contact the tape roll are the locking pads 23 and 24 which are defined at the lower ends of the resilient side grippers 16 and 17.

It is obvious that the cutting edge does not have to be constructed as an integral part of the body, but could be made of a different material such as metal and attached to the cutter by any of a number of obvious methods such as the cutter being inserted within a front transverse slit and fused or pinched to be held in place.

FIGS. 14–19 of the drawing illustrate an embodiment of the invention providing a tape cutting tool specifically for rolled medical adhesive tape or the like which is supplied on the core of a side-rimmed spool with a circular cover encasement. This embodiment provides an inexpensive cutter, simple in design and ease of application allowing continued use of the cutter with the added advantage of being able to store the cutter within the spool encasement while still on the tape between the spool rims for future and repeated use until such time as the tape has been completely dispensed. The cutter can be easily removed and snapped into another spool, and is designed to greatly assist in the ease of cutting the fibrous medical tape by the elderly as well as the average person.

In accordance with the invention the cutter 26 is placed between the spool rims with the cutting edge 27 facing forward and in the same direction and behind the leading edge of the tape, then pressed down between the rims of the spool 40 and 41 and in contact with the circumferential surface of the medical tape 38. The user places his (her) undex finger through the core of the spool, and thumb on the forward thumb support deck 29. When thus engaged the padding of the thumb presses against the transverse support ridge 30, firmly supporting the cutter as it slides along the surface of the roll while pulling the tape through with the other hand. In this position the user lifts the end of the tape with the other hand, pulls a length of tape allowing the cutter 26 to slide along the circumferential surface of the roll 38 while the index finger supports the turning spool. The user lifts the tape back and over the cutting edge 27 and extension ribs 28 and twists to the left or right to engage the starter point 36 or 37 which easily rips the edge of the fibrous tape sufficiently to weaken its resistance during the follow-through of the tape being drawn against the rest of the transverse cutting edge 27 and through the transverse extension ribs 28. Because the cutting edge 27 is sharply raised above the surface of the roll of tape end will remain raised and curled back and engaged between the cutting point 27 after cutting. The cutter 26 is held in position and guided between the rims of the spool by the two resilient side pressure tabs 32 and 33. In their natural position the said pressure tabs extend outwardly beyond the full width of the body 26. Both tab 32 and 33 are notched out of the side of the body and set back of the cutting edge portion 27 and 28 so as not to interfere with the lifted edge of the tape during the cutting process. When forced between the spool rims the said tabs provide sufficient spring-like counterpressure outwardly against the inner sides of the spool rims 40 and 41 to prevent it from falling off the tape surface. While thus engaged the resilient side pressure tabs 32 and 33 are forced inwardly toward the tab notches 34 and 35. The transverse underside of the rear portion 42 of the body 26 is curved slightly to conform to the circumference of the roll at c–d which places the cutter in a snug position on the surface of the tape roll. In this position the body 26 is resting on the tape roll but below the periphery of the edges of the rims 40 and 41 which will allow the spool encasement cover 44 to be properly placed over the spool enclosing the cutter 26 along with the tape for safekeeping. The resilient side pressure tabs 32 and 33 will return to their original extended position when removed from the spool. The said tabs 32 and 33 provide suitable pressure against the inner sides of the spool rims 40 and 41 for holding the body within the spool but not so as to prevent slideability. The rear underside 42 is curved and smooth enough to hug the surface of the roll but not so as to inhibit slideability. The rear position of the body 26 angles down and back from the transverse support ridge 30 to form the rear transverse support deck 31 against which the thumb an be placed for forward pushing of the body. The combined use of the rear transverse deck 31 and the transverse support ridge 30 allow easy forward and reverse manipulation of the cutter. The underside portion 42 of the rear support deck 31 transversely curves from its rear edge c forward to d in conformity with the circumference of the tape roll which is sufficient to accommodate proper contact with the roll as it will reduce in circumference during use. The underside portion 43 of the forward thumb support deck 29 "S" curves sharply from d upward and away from the surface of the roll. This upward curve 43 positions the transverse cutting edge 27 up from the surface of the roll at such an angle to allow the tape to engage the starter point 36 or 37 at the angle most effective for ease of initial puncturing and follow-through cutting of the fibrous tape.

The embodiments of the invention described above are intended to be illustrative of the invention but not restrictive of its scope, the scope of the invention being defined by the following claims and all equivalents thereto.

I claim:

1. A cutter device for rolled tape on a spool having two opposed spool rims for carrying a roll of tape wound on a core within opposed inner sidewalls of said opposed spool rims, said cutter device comprising:

a body portion having a lower surface adapted to slideably move along the periphery of a roll of tape wound on said core within said opposed inner sidewalls of said spool rims, said lower surface being contoured upwardly in a direction towards a front end of said body portion to define a recessed space between said front end and the outer circumference of said roll of tape when said body portion is mounted on said roll of tape, a cutting edge on said front end, and a pair of opposed resilient side members, each of which extends laterally from opposed sides of said body portion for exerting a biasing force outwardly against the inner surfaces of said opposed rims of said tape spool to maintain said cutter device removably mounted to said roll of tape within said opposed spool rims.

2. The device of claim 1 wherein said contour of said lower surface is designed so that a leading edge of tape will be raised from said roll of tape after a piece of tape is severed from said roll of tape.

3. The device of claim 1 wherein the dimensions of said body are selected so that said cutter device is accommodated within a storage encasement for said tape spool mounted over said opposed rims such that said cutter device is adapted to being stored on said roll of tape and within said tape spool and said storage encasement.

4. The device of claim 1 wherein said cutting edge projects at an angle to facilitate cutting of tape from said roll of tape.

* * * * *